US005170760A

United States Patent [19]

Yamada et al.

[11] Patent Number: 5,170,760

[45] Date of Patent: Dec. 15, 1992

[54] IGNITION SYSTEM FOR TWO CYCLE ENGINE

[75] Inventors: Akira Yamada; Miyoshi Ishibashi, both of Iwata, Japan

[73] Assignee: Yamaha Hatsudoki Babushiki Kaisha, Iwata, Japan

[21] Appl. No.: 791,466

[22] Filed: Nov. 13, 1991

[30] Foreign Application Priority Data

Nov. 13, 1990 [JP] Japan ..... 2-307950
Nov. 13, 1990 [JP] Japan ..... 2-307952

[51] Int. Cl.[5] ..... F02M 45/02; F02M 51/00; F02D 41/34; F02P 3/09

[52] U.S. Cl. ..... 123/295; 123/73 C; 123/430; 123/299; 123/620; 123/602

[58] Field of Search ..... 123/73 C, 295, 298, 123/299, 300, 305, 430, 443, 596, 597, 602, 605, 620

[56] References Cited

U.S. PATENT DOCUMENTS

| | | | |
|---|---|---|---|
| 3,154,059 | 10/1964 | Witzky et al. | 123/295 X |
| 4,345,575 | 8/1982 | Jorgensen | 123/620 X |
| 4,480,620 | 11/1984 | Tange et al. | 123/295 X |
| 4,886,036 | 12/1989 | Johansson et al. | 123/620 X |
| 4,920,937 | 5/1990 | Sasaki et al. | 123/305 |
| 5,054,444 | 10/1991 | Morikawa | 123/295 |
| 5,078,107 | 1/1992 | Morikawa | 123/295 |
| 5,086,737 | 2/1992 | Watanabe et al. | 123/295 |

*Primary Examiner*—Willis R. Wolfe
*Attorney, Agent, or Firm*—Ernest A. Beutler

[57] ABSTRACT

An improved method of operating a two cycle direct injected internal combustion engine so as to provide good ignition and combustion even when operating in a stratified condition. This is achieved either by extending the duration of firing of the spark plug either by extending a single firing or providing multiple firings per cycle or by changing the energy level across the gap of the spark plug during its firing.

42 Claims, 9 Drawing Sheets

*Figure 10*

| | | | | | | | |
|---|---|---|---|---|---|---|---|
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 1 | 1 | 1 | 1 | 1 | 1 | 1 | 1 |
| 2 | 2 | 2 | 2 | 1 | 1 | 1 | 1 |
| 3 | 3 | 3 | 2 | 1 | 1 | 1 | 1 |
| 4 | 4 | 3 | 2 | 1 | 1 | 1 | 1 |
| 4 | 4 | 3 | 2 | 1 | 1 | 1 | 1 |

Throttle Opening Area

Engine speed

IGNITION SYSTEM FOR TWO CYCLE ENGINE

BACKGROUND OF THE INVENTION

This invention relates to an ignition system for a two cycle engine and more particularly to an improved ignition system for a direct injected internal combustion engine.

The advantages of direct cylinder injection as opposed to manifold injection or carburetion are well known. By employing direct cylinder injection, it is possible to operate the engine at leaner mixtures than with other types of charge forming systems, particularly at low, light and medium loads. The reason for this is the direct cylinder injection permits the use of a stratified or laminar type of combustion wherein a stoiciometric fuel/air mixture is disposed only within a limited area of the combustion chamber at the time combustion begins. With other types of charge forming systems, it is substantially necessary to provide a homogeneous stoiciometric charge completely within the combustion chamber regardless of the load or operating condition. These advantages are particularly important with two cycle internal combustion engines due to the fact that the porting of these engines can give rise to the loss of unburned hydrocarbons through the exhaust port when a homogeneous mixture is inducted into the engine.

However, when a stratified charge is present in the combustion chamber and the engine is spark ignited, it is necessary to insure that the fuel/air mixture is in the vicinity of the spark gap at the time the spark plug is fired. If it is not, either incomplete combustion or no firing at all may result. Of course, it can be insured that the complete mixture will be ignited if multiple spark plugs or multiple spark firings are employed. However, the use of multiple spark plugs gives rise to a complicated cylinder head and also added costs. The use of multiple firing of the spark plug gives rise to other problems. First, a relatively complicated ignition system is necessary and by firing the spark plug a multiple number of times for each revolution of the engine undue heat can be generated in the ignition system causing premature failure.

The problems aforenoted are particularly aggravated when capacitor discharge ignition systems (CDI) are employed, as are desirable with two cycle engines. A capacitor discharge ignition system, although it has the advantages of high initial energy, has a shorter spark duration than a breaker type ignition system. As a result of this shorter spark period, the problems of making sure that the spark plug fires when a charge is in connect with its gap become greater. However, capacitor discharge ignition systems are particularly useful with two cycle engines because their high energy level will insure that deposits are burned off of the spark plug.

It is, therefore, a principal object to this invention to provide an improved ignition system for an internal combustion engine.

It is a further object to this invention to provide an ignition system that will insure firing of a stratified charge but which will not consume excessive spark energy when not required.

It is a further object to this invention to provide an ignition system for an internal combustion engine that senses when there is a homogeneous mixture in the cylinder and when there is a stratified charge and fires the spark plug accordingly so as to insure ignition under all circumstances.

SUMMARY OF THE INVENTION

A first feature of the invention is adapted to be embodied in a spark ignition system for an internal combustion engine having a combustion chamber and charge forming means for charging a fuel/air mixture into the combustion chamber. The charge forming means selectively charges the combustion chamber with either a stratified or homogeneous fuel/air charge depending upon the running conditions. Spark plug means are providing in the combustion chamber for firing the fuel/air charge therein. Means are provided for firing the spark plug means at a higher energy level or longer duration when the fuel/air charge is stratified then when the fuel/air charge is homogeneous.

Another feature of the invention is adapted to be embodied in a method for operating a spark ignition system of an internal combustion engine having a combustion chamber, charge forming means and a spark plug as set forth in the preceding paragraph. In conjunction with the method, the engine conditions is sensed to determine if there is a stratified charge in the combustion chamber and if so, the spark plug is fired at either a higher energy level or for a longer duration than when the charge is homogeneous.

BRIEF DESCRIPTION OF THE DRAWINGS

FIG. 10 is a graphical view showing the map for determining the number of spark plug firings in relation to engine speed and throttle opening.

DETAILED DESCRIPTION OF THE PREFERRED EMBODIMENTS OF THE INVENTION

Figure 1:
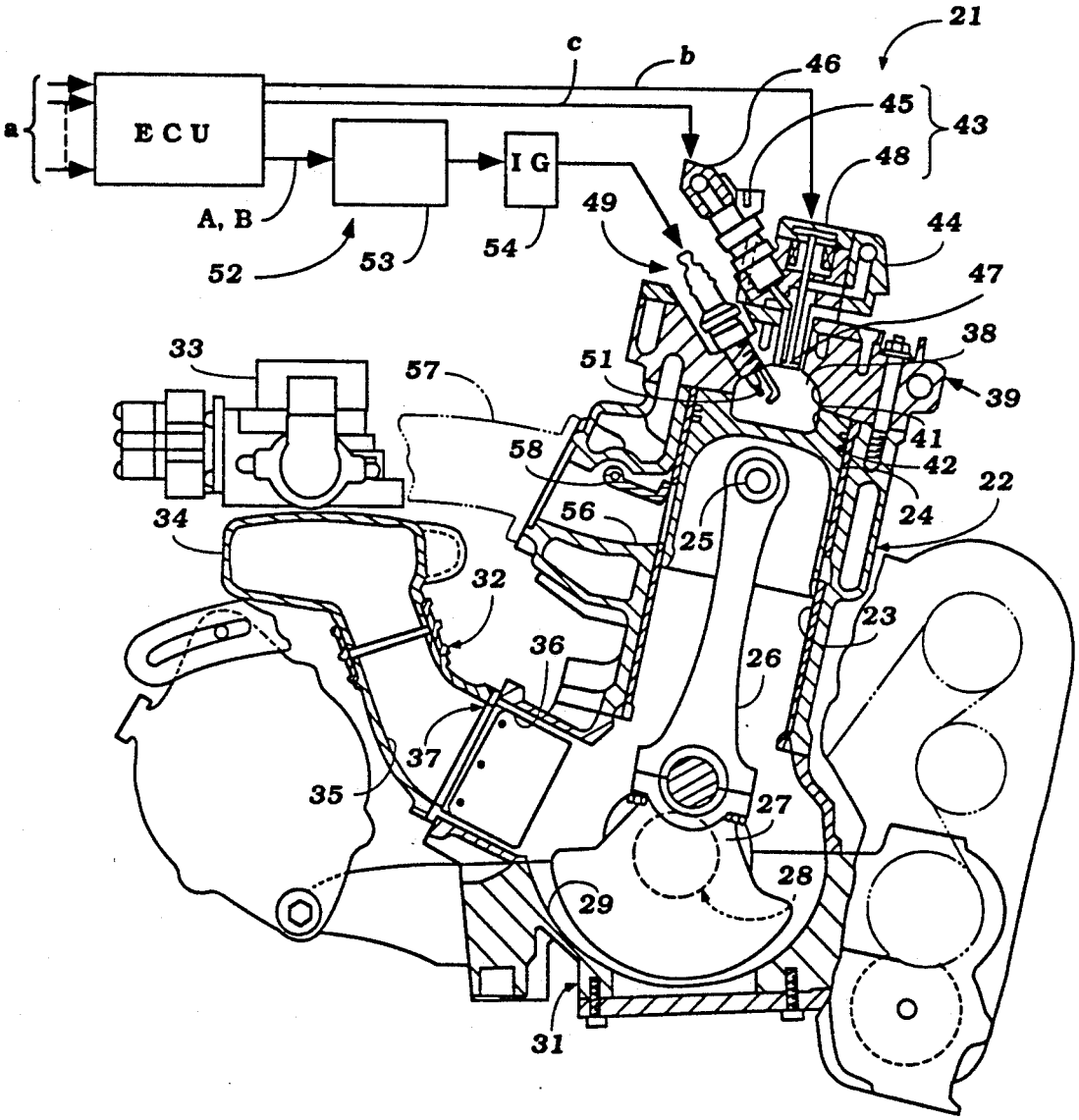
FIG. 1 is a cross sectional view taken through a single cylinder of a multiple cylinder internal combustion engine constructed in accordance with an embodiment of the invention and having its spark ignition system fired in accordance with an embodiment of the invention.

Referring first to FIG. 1, a three cylinder, inline, crankcase compression engine operating in accordance with an embodiment of the invention is identified generally by the reference numeral 21 and is shown primarily in a transverse cross section through one cylinder of the engine. Although the invention is described in conjunction with a three cylinder, inline engine, it should be readily apparent that the invention may be employed in conjunction with engines having other number of cylinders or non-reciprocating engines and other configurations. Also, although the invention has particular utility in conjunction with two cycle engines, facets of the invention may be employed with four cycle engines.

The engine 21 includes a cylinder block 22 having three aligned cylinder bores 23 each formed by a respective liner inserted into the cylinder block 22. A piston 24 reciprocates in each cylinder bore 23 and is connected by means of a piston pin 25 to the upper or small end of a connecting rod 26. The lower or big end of the connecting rod 26 is connected to a throw 27 of a crankshaft, indicated generally by the reference numeral 28. The crankshaft 28 is rotatably journaled within a crankcase chamber 29 formed by the lower portion of the cylinder block 22 and a crankcase member 31 which is affixed to the cylinder block 22 in a known manner. The crankshaft 28 is rotatably journaled in a known manner and each of the crankcase chambers 29 associated with the respective cylinder bores 23 are sealed from each other, as is typical with two cycle, crankcase compression engines.

An intake charge of air is delivered into each crankcase chamber 29 as its respective piston 24 moves upwardly from an induction system, indicated generally by the reference numeral 32. This induction system 32 includes an air inlet silencing and filtering device (not shown) that delivers air to a throttle body 33 in which a flow controlling throttle valve (not shown) is positioned. The throttle body 33 serves a plenum chamber 34 which, in turn, supplies air to individual runners 35 of a manifold which communicates with intake ports 36 formed in the crankcase member 31. Reed type check valves 37 are provided in each of the intake ports 36 so as to preclude reverse flow through the induction system 32 when the piston 24 moves downwardly.

When the pistons 24 move downwardly, the charge drawn into the crankcase chambers 29 will be compressed and transferred to the area above the heads of the pistons 24 through suitable scavenge passages (not shown) that extend through the cylinder block 22. This charge is delivered to a combustion chamber, indicated generally by the reference numeral 38 and which is formed in part by the head of the piston 24 and a cylinder head assembly 39 that is affixed to the cylinder block 22 in a known manner. The cylinder head assembly 39 defines a recess 41 which cooperates with a bowl 42 formed in the head of the piston 24 to provide the minimum volume of the combustion chamber 38 when the piston 24 is at top dead center, as shown in FIG. 1.

A fuel/air charge is sprayed into the combustion chamber 38 from a fuel/air injector assembly, indicated generally by the reference numeral 43 and which is mounted within the cylinder head 39 in a suitable manner. The fuel/air injector 43 includes an injector body that defines a chamber to which compressed air is delivered by manifold 44 from a remotely positioned air compressor (not shown). In addition, fuel is sprayed into this chamber from a fuel injector 45 which receives fuel from a fuel manifold 46 under regulated pressure. The air and fuel are selectively delivered to the combustion chambers 39 by opening and closing of an injection valve 47 that is controlled by an electrical solenoid 48. The specific type of fuel/air injector employed is not critical to the invention and the invention may also be utilized in conjunction with engines having only direct cylinder fuel injection.

The fuel/air charge delivered to the combustion chamber 38 will vary in strength depending upon the load and speed conditions of the engine and under low speed low load conditions, the charge will be stratified while under high speed high load conditions, the charge will be substantially homogeneous.

The compressed charge is then fired by a spark plug 49 which its mounted in the cylinder head 39 and has its spark gap 51 protruding into the combustion chamber 38. The spark plug 49 is fired by an ignition circuit, indicated generally by the reference numeral 52 which is comprised of a multiple ignition unit 53 and a spark coil 54 that is associated with the spark plug 49. The multiple ignition unit 53 is controlled by an ECU 55 by a control strategy which will be described. The ECU outputs either multiple or non-multiple firing pulses A, B to the multiple ignition unit 53 for firing it in a manner which will be described. In addition, the ECU outputs a signal c to the fuel injector 46 for controlling the amount of fuel injected and an injection valve control signal b for operating the solenoid 48 and controlling the timing and duration of opening of the injection valve 47. The ECU 55 receives a number of detection signals a from sensors indicating various operating conditions of the engine such as throttle opening, engine speed, crank angle, compressed air pressure in the manifold 44, engine temperature, cylinder pressure, ignition coil temperature, cooling water, and so forth. The control strategy for the fuel injection system and specifically the injector 43 may be of any known type and that for firing of the spark plug 49 will be described.

Once the charge in the combustion chamber 38 has been ignited, the piston 24 will be driven downwardly and eventually an exhaust port 56 formed in the cylinder block 22 will be opened so as to permit the exit of the exhaust gases to an exhaust manifold 57. An exhaust control valve 58 may be positioned in the exhaust port 56 for controlling the timing of the opening and closing of the exhaust port 56 with any desired strategy, which also may be controlled by the ECU 55.

Figure 2:
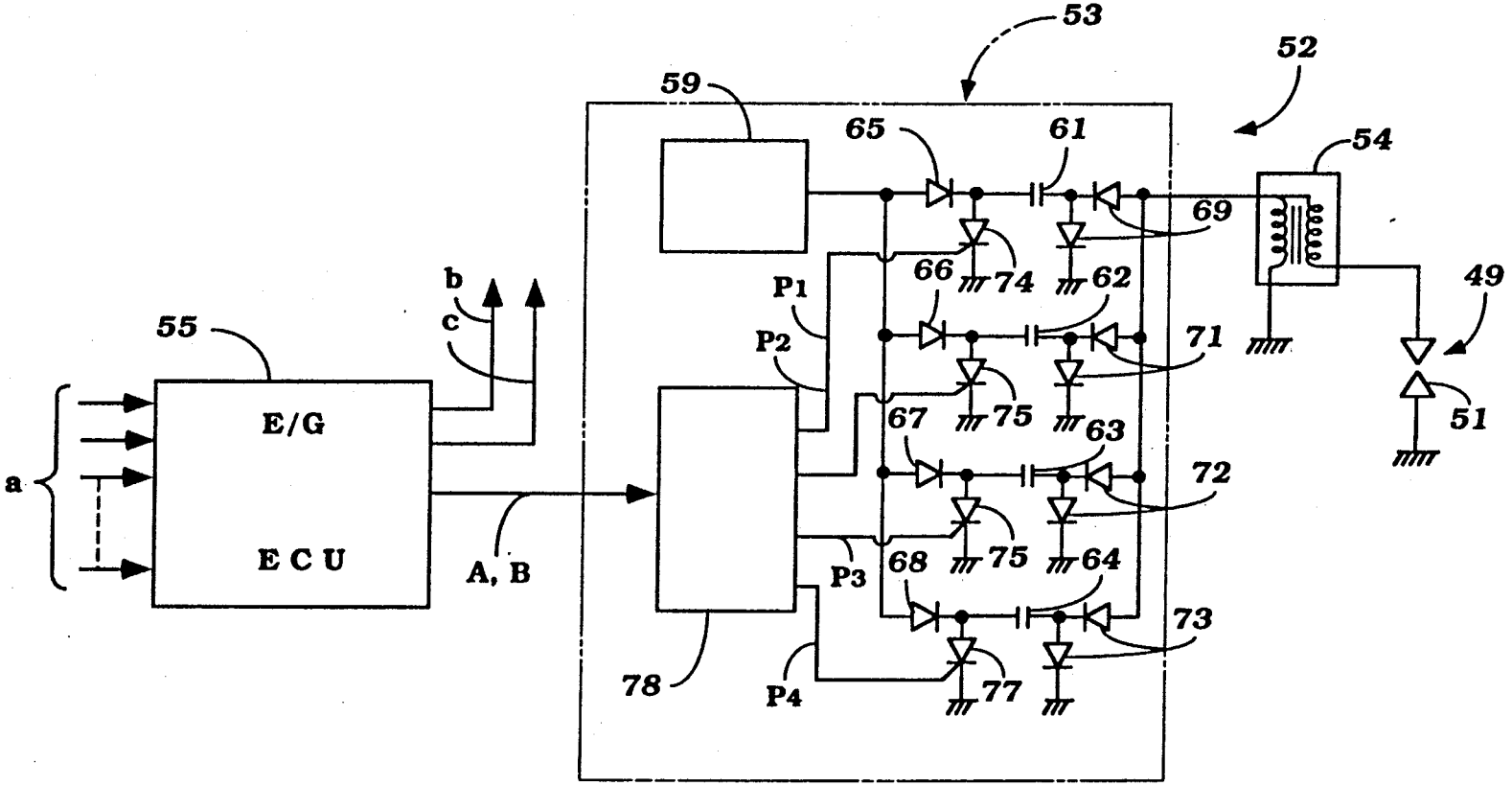
FIG. 2 is a schematic view showing the ignition circuit of the engine.

The ignition circuit associated with one of the spark plugs 49 will now be described by particular reference to FIG. 2. As has been noted, the ignition circuit receives pulses A, B from the ECU 55 to vary the number of times when the spark plug 49 is fired for each cycle. The ignition circuit 53 includes a high voltage charging source 59 which may be the output from a charging coil of a magneto ignition system for the engine 21 and which charges a plurality of capacitors, 61, 62, 63 and 64 through parallel circuits which include respective diodes, 65, 66, 67 and 68. In the illustrated embodiment, there are four capacitors, 61, 62, 63 and 64 because four is the maximum number of times the spark plug 49 will be fired during a single cycle. As will become apparent by reference to other embodiments, it is possible to provide an arrangement wherein there need not be provided a separate capacitor for each desired firing of the spark plug 49 for a given cycle.

There are also provided pairs of protecting diodes, 69, 71, 72 and 73 in the circuits connecting the capacitors, 61, 62, 63 and 64 with the spark coil 54.

The discharge of each of the capacitors, 61, 62, 63 and 64 is controlled by a respective thyrister, 74, 75, 76 and 77 which is switched by a respective pulsing signals, $P_1$, $P_2$, $P_3$ and $P_4$. These pulsing signals, $P_1$, $P_2$, $P_3$ and $P_4$ are derived from an ignition pulse distributing circuit 78 which receives the pulse signals A, B from the ECU 55.

As is well known, each time one of these thyristers, 74, 75, 76 and 77 is switched on, the respective capacitors, 61, 62, 63, and 64 will be discharged and a current will be induced in the primary winding of the coil 54 which causes a high voltage current to be induced in the secondary wiring and effect firing of the spark plug 49.

Figure 3:
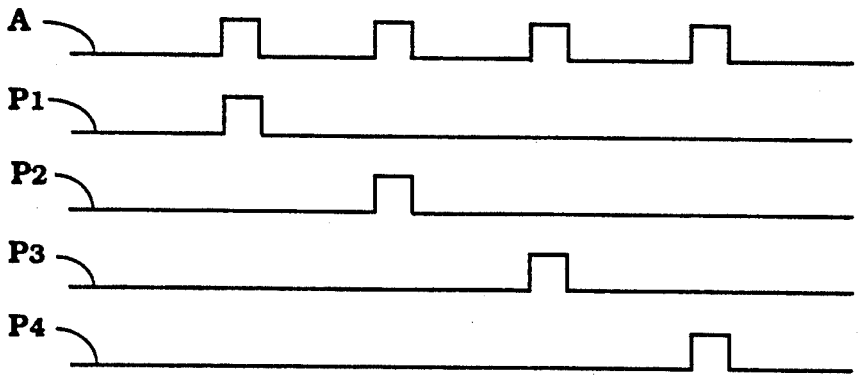
FIG. 3 is a graphical view showing the ignition triggering pulses and spark plug firings in accordance with the operation of the embodiment when there is a stratified charge in the combustion chamber.
Figure 4:
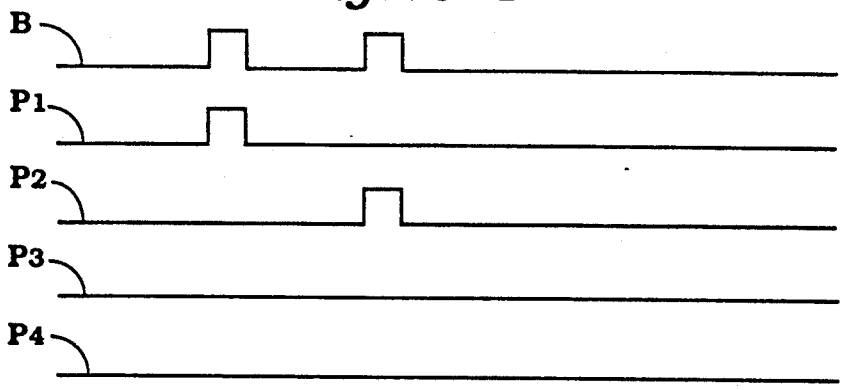
FIG. 4 is a graphical view, in part similar to FIG. 3, and shows the operation when there is a homogeneous mixture in the combustion chamber.

FIGS. 3 and 4 depict the relationship between the multiple firing pulse signal A which is employed in the stratified or laminar combustion phase and the lesser multiple firing pulse B which is generated during the homogeneous mixture phase. It will be seen when the signal A is given, four pulses are generated which cause each of the pulse signals, $P_1$, $P_2$, $P_3$ and $P_4$ to be generated and the spark plug will fire four times during a given cycle. This has the effect of increasing the firing time as shown on the timing diagram of FIG. 5.

Figure 5:
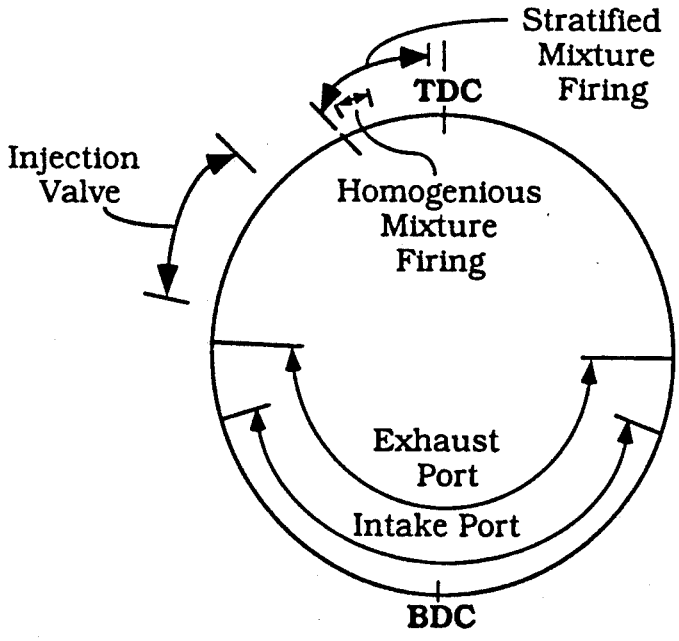
FIG. 5 is a timing diagram showing the intake and exhaust port openings and ignition impulses in accordance with the invention.

When operating with a homogeneous mixture, the signal B is given which effects only generation of the pulses $P_1$ and $P_2$ by the ignition pulse distributing circuit 78 and the spark plug will be fired only twice to give a shorter firing time as shown in the timing chart of FIG. 5. However, each system will insure complete combustion for the given running characteristic of the engine.

The ECU 55 is programed to give the stratified ignition pulse A under the following conditions:

1. When fuel is injected for only a short duration after the engine exhaust port 56 is closed, for example when idling, running at low speed or low loads or the like.

2. When the engine is being started as judged by the condition of the starter switch and the engine speed so as to prevent spark plug following as caused by the increased amount of fuel supplied during starting.

3. When the pressure of air delivered to the air/fuel injector 43 is insufficient to cause good vaporization of the fuel. This condition can also occur during starting and extreme low speed operation.

4. When the engine temperature is low as sensed either by cooling water temperature or cylinder head temperature and condensation of fuel and poor ignition may be a problem.

5. To prevent misfiring conditions by multiple firing when the pressure or the ignition state in the combustion chamber indicates misfiring.

6. To self clean contamination from the spark gap 51 of the spark plug 49 by sensing the electric static breakdown voltage at discharge conditions which indicates contamination.

The homogeneous ignition pulse B is given out in the following conditions:

1. When fuel is injected for a long duration and particularly when fuel injection begins at or before the time of exhaust port closure as under high speed high load running conditions or the like.

2. When the temperature of the ignition coil 54 is sensed to be high, to prevent breakdown of the ignition coil since its temperature rises as the number of times of spark firing is increased.

Figure 6:
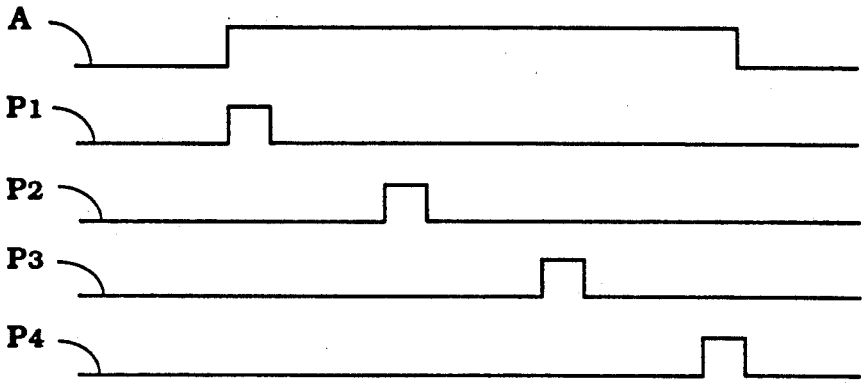
FIG. 6 is a graphical view, in part similar to FIG. 3, and shows another way of achieving the multiple firing of the spark plugs.
Figure 7:
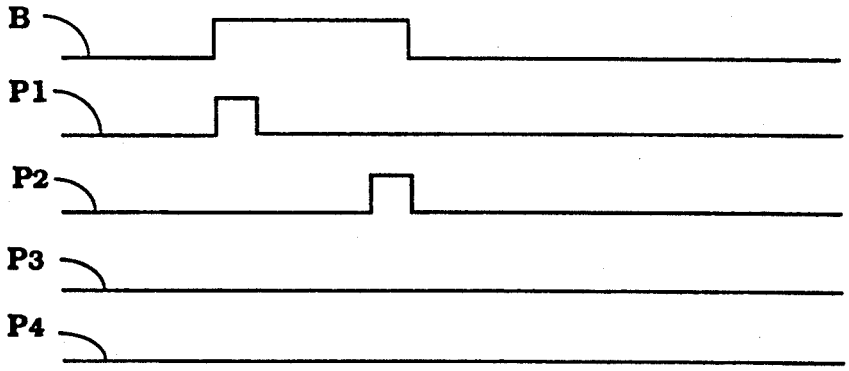
FIG. 7 is a graphical view, in part similar to FIG. 4, and shows the way in which the spark plugs are fired in connection with this embodiment.

In the embodiment as thus far described, the ECU outputs control pulses A and B which, as shown in FIG. 4, may comprise an individual pulse for each signal to actuate the output pulses $P_1$, $P_2$, $P_3$ and/or $P_4$ from the pulse distributing circuit 78. Alternatively, the ECU 55 may output individual pulses A and B of durations necessary to cause the pulse distribution circuit 78 to output the individual pulses $P_1$, $P_2$, $P_3$ and/or $P_4$ as shown in FIGS. 6 and 7. That is, the longer the duration of the output pulse from the ECU 55, the more individual pulses $P_1$, $P_2$, $P_3$ and $P_4$ will be generated. Either type of circuit can be readily employed by those skilled in the art.

Figure 8:
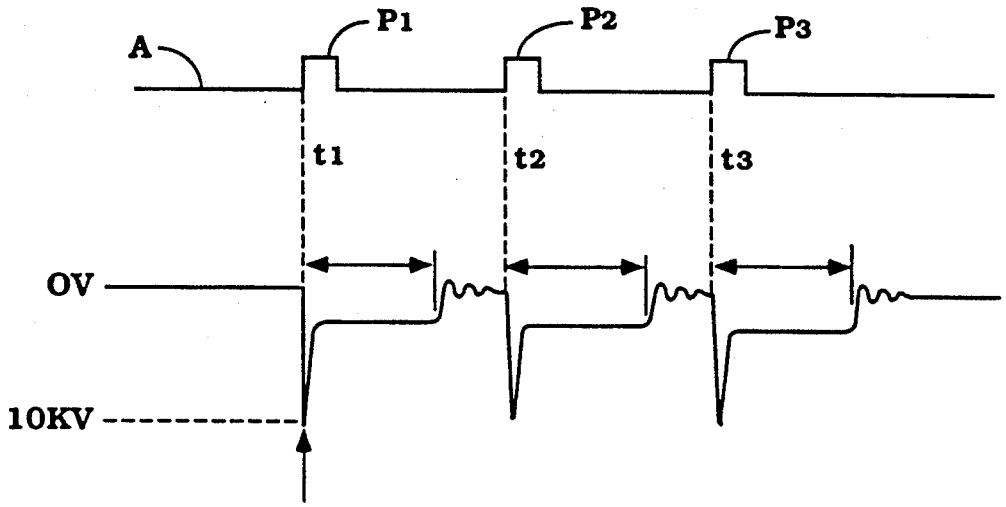
FIG. 8 is a graphical view showing the ignition triggering pulses and the spark plug firing in accordance with the embodiment of FIGS. 3 and 4.
Figure 9:
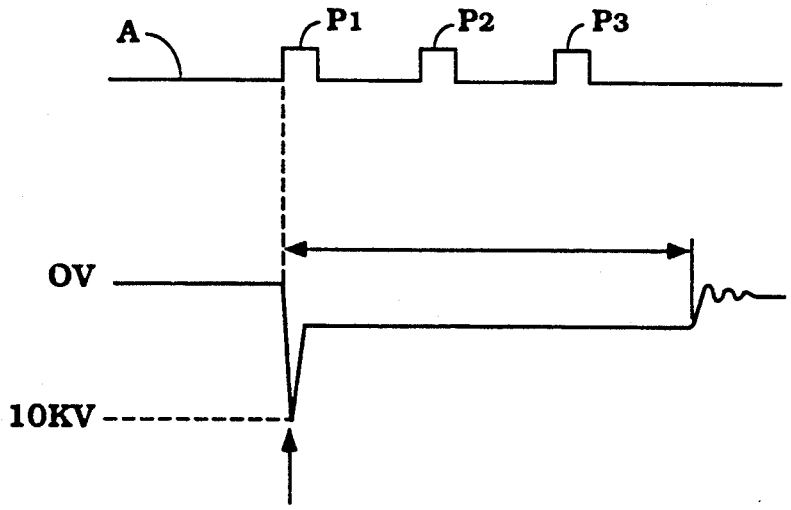
FIG. 9 is a graphical view, in part similar to FIG. 8, and shows the firing condition in accordance with the embodiment of FIGS. 6 and 7.

In the embodiments as thus far described, each of the pulses $P_1$, $P_2$, $P_3$ and $P_4$ causes a separate firing of the individual spark plug 49. However, it can be such that the pulses generated by the pulse distributing circuit 78 is such that the pulses $P_1$, $P_2$, $P_3$ and $P_4$ are generated at a frequency such that it will increase the duration of the firing of the spark plug 49 rather than causing more individual firings. FIGS. 8 and 9 show such an arrangement.

As may be seen in FIG. 8, individual pulses $P_1$, $P_2$ and $P_3$ are generated beginning at the times $t_1$, $t_2$ and $t_3$ which times are spaced sufficiently so that the spark plug will fire as shown in FIG. 8. It should be noted that the voltage across the spark plug reaches a high voltage of 10 kilovolts which causes a breakdown in the gap between the electrodes 51 and then the voltage across the gap will be less until firing terminates. This depends upon the time for discharge of the individual capacitors. However, rather than causing this type of an arrangement, the pulses $P_1$, $P_2$ and $P_3$ may be timed sufficiently so that the pulse $P_2$ is generated before the discharge across the gap is such that a spark will no longer jump and hence a continuous longer spark interval will be achieved as shown in FIG. 9.

The arrangement shown in FIG. 8 is particularly useful in circumstances when fouling of the spark plug may occur so as to provide several high voltages each cycle so as to burn off deposits. However and has been previously noted, this causes a greater heat in the system and when spark plug fouling is not a problem, the duration of the spark may be increased as shown in FIG. 9.

It has been noted that the important feature of the invention is to have the spark plugs 49 fired more frequently under certain circumstances, normally low speed and low throttle opening than under high speed high throttle opening or high speed high load conditions. The previous examples have given four firings at the stratified charge phase and two firings at the homogenous phase. However, a varying number of multiple firings may be employed and FIG. 10 shows a graph of firings in response to various throttle openings and engine speeds wherein the firings can go from four to three to two to one. Rather than individual firings, as aforedescribed, the numbers may be representative of the length of the time of discharge across the spark gap rather than the number of firings.

Figure 11:
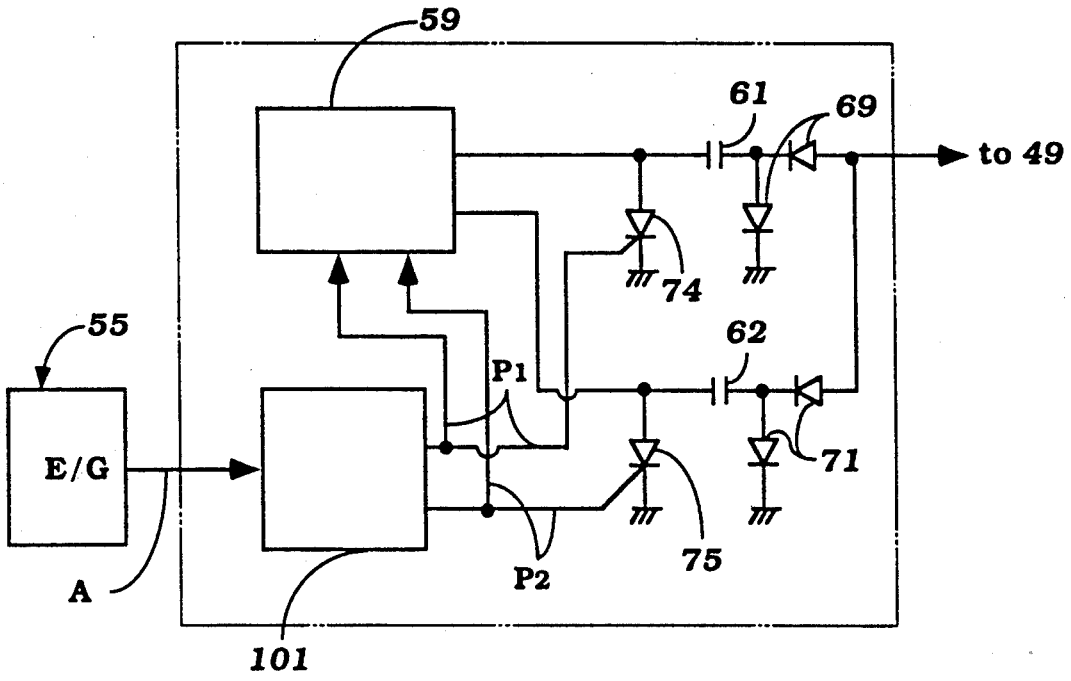
FIG. 11 is a schematic electrical diagram, in part similar to FIG. 2, and shows another embodiment of the invention.
Figure 12:
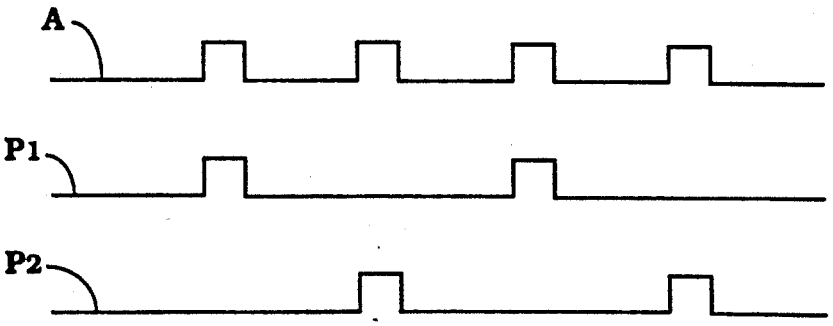
FIG. 12 is a graphical view showing the method this embodiment employs for multiple firing of the spark plugs.

The embodiments of the invention as thus far described the spark plug firings circuits have employed a number of thyristers and charging capacitors which are equal to the maximum number of spark plug firings desired or the maximum duration of firing. FIGS. 11 and 12 show another embodiment of the invention wherein the firing circuit employs a lesser number of charging capacitors and thyristers and wherein each thyrister and charging capacitor may be operated more than once each cycle of operation. Generally the circuit of this embodiment is the same as that of FIG. 2 and, for that reason, components which are the same have been identified by the same reference numerals and will not be described again. However, it should be noted that in this embodiment there are only two capacitors 61 and 62 and two thyristers 74 and 75. An ignition pulse distributing circuit 101 is provides alternate output pulses $P_1$ and $P_2$ of a number of times in response to the output signal A from the ECU. It should be noted that for each pulse from the ECU, the ignition pulse distributing circuit alternates the outputs $P_1$ and $P_2$ so as to selectively discharge the capacitor 61 and 62 which are alternately charged by the charging circuit 59. As a result, a simpler circuit can be employed.

Figure 13:
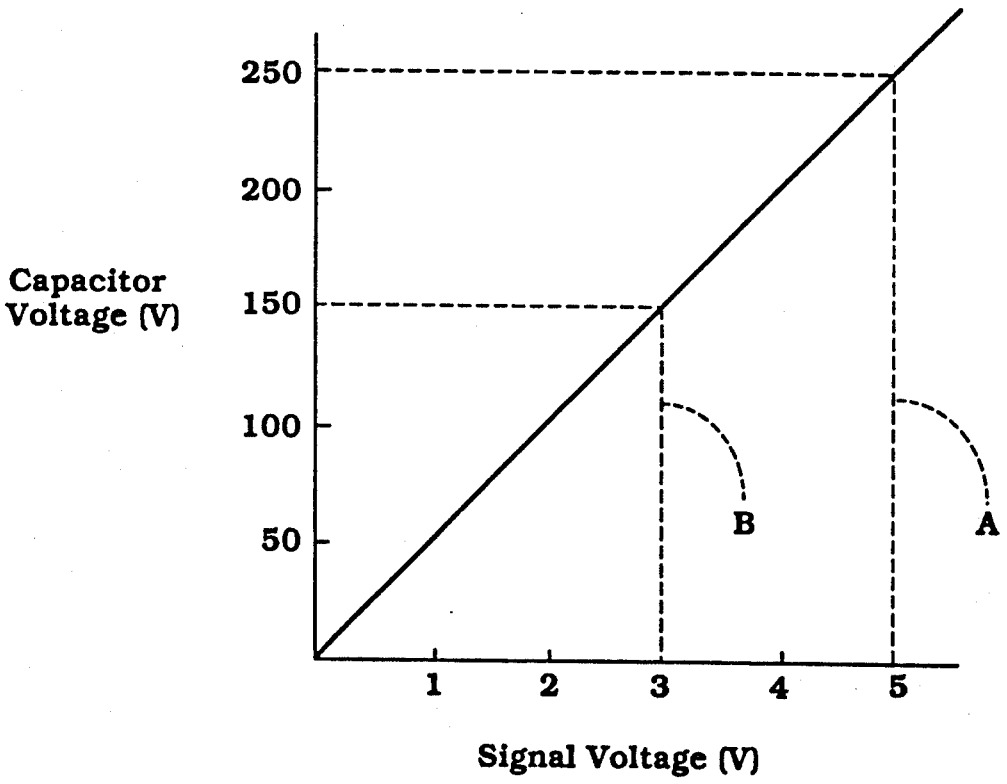
FIG. 13 is a graphical view showing the voltage levels in the ignition system in accordance with another embodiment of the invention.
Figure 14:
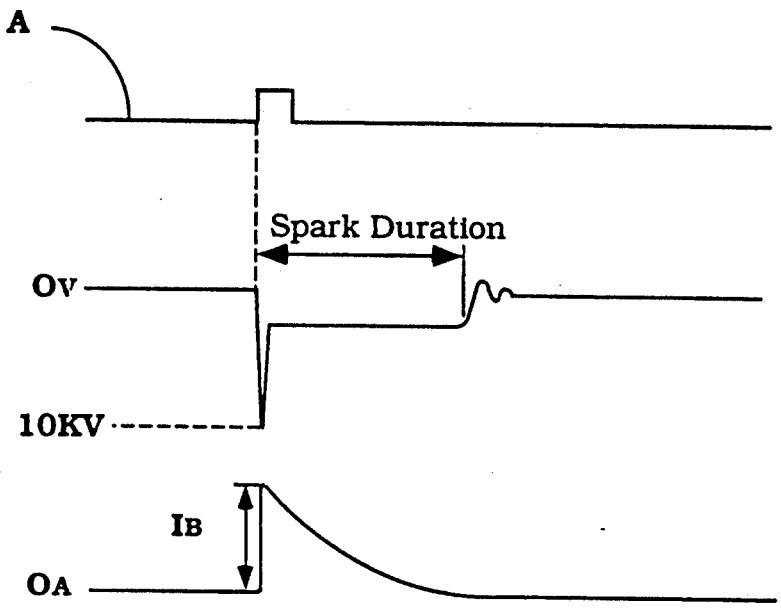
FIG. 14 is a graphical view showing how the voltage varies under one running condition with this embodiment.
Figure 15:
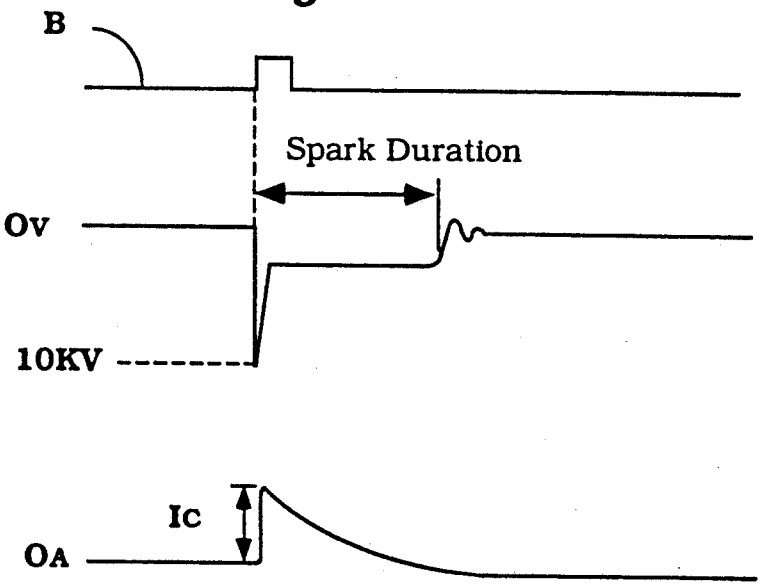
FIG. 15 is a graphical view, in part similar to FIG. 14, showing the voltage variations during another mode of operation of this embodiment.

In the embodiments of the invention as thus far described, the combustion in the laminar or stratified phase has been improved and insured by either firing the spark plug a greater number of times or for a longer duration when operating under the homogenous condition. The same effect may be achieved by applying a greater power to the spark plug under the stratified condition than under the homogenous condition and FIGS. 13 through 15 show such an embodiment.

When the engine is determined to be operating in the homogenous phase as sensed by the ECU 55, a pulse control circuit 101 as in the embodiment of FIG. 11, outputs a control signal B to the high voltage source 59 which is in approximately three volts so that the high voltage source outputs a voltage of approximately 150 volts to the capacitor 61. As a result, when the spark fires it will be with lower energy as shown in FIG. 15. On the other hand, when the engine is determined to be running in the stratified phase as sensed by the ECU 55, the pulse control circuit 101 outputs a higher voltage signal A (approximately 5 volts) to the high voltage source 59 and the high voltage source then imposes a voltage of approximately 250 volts on the capacitor 61 to cause a higher energy at the ignition as shown in FIG. 14.

In this embodiment, the number of firings of the spark plug under either stratified or homogenous phases are the same and may, for example, be four times per cycle. Of course, other members of firings are possible but it will be seen that the application of higher energy under the stratified condition will insure that the mixture is ignited and well burned. By dropping the voltage under the homogenous phase, the depletion of the battery will be avoided.

In connection with all of the embodiments disclosed, the initial spark firing regardless of the phase is determined by a fixed map, which map may vary depending upon operating in the homogenous or stratified phases. That is, the additional firings take place after the initial timing regardless of the mode of operation.

It should be readily apparent from the foregoing description that the described embodiments of the invention are very effective in insuring that the mixture in a direct injected engine will be ignited and well burned regardless of whether operating in a stratified or homogeneous phase. Also, the spark plug can be easily kept clean under extremely adverse conditions and the amount of electrical energy consumed is not excessive nor is there excessive heating of the coil or other ignition components. Of course, the foregoing description is that of preferred embodiments of the invention and various changes and modifications may be made without departing from the spirit and scope of the invention as defined by the appended claims.

We claim:

1. A spark ignition system for an internal combustion engine having a combustion chamber, charge forming means for charging a fuel/air mixture into said combustion chamber, said charge forming means selectively charging said combustion chamber with either a stratified or a homogenous fuel/air charge, spark plug means in said combustion chamber for firing the fuel/air charge therein, and means for firing said spark plug means at a higher energy level or longer duration when said fuel/air charge is stratified than when said fuel/air charge is homogenous.

2. A spark ignition system as set forth in claim 1 wherein the means for firing the spark plug means fires it at a higher energy level when the fuel/air charge is stratified.

3. A spark ignition system as set forth in claim 2 wherein the higher energy level is achieved by providing a greater current flow across the spark plug when the charge is stratified.

4. A spark ignition system as set forth in claim 3 wherein the higher energy level is derived from a capacitor discharge ignition system by charging the capacitor at a higher voltage when the charge is stratified.

5. A spark ignition system as set forth in claim 1 wherein the means for firing the spark plug fires the spark plug for a longer duration when the fuel/air charge is stratified.

6. A spark ignition system as set forth in claim 5 wherein the longer duration is achieved by providing a longer length of time which the spark plug fires.

7. A spark ignition system as set forth in claim 6 wherein the spark plug is fired by a capacitor discharge circuit and the time is firing is extended by multiple capacitor discharges during the spark interval.

8. A spark ignition system as set forth in claim 5 wherein the spark plug duration of firing is increased by firing the spark plug at a multiple number of times.

9. A spark ignition system as set forth in claim 8 wherein the multiple firing of the spark plug is achieved by a capacitor discharge circuit having a plurality of capacitors and thyristers for selectively discharging the capacitors.

10. A spark ignition system as set forth in claim 9 wherein there are a lesser number of capacitors and thyristers than the number of times the spark plug is fired so that each capacitor is discharged a plurality of times during a single cycle of the engine.

11. A spark ignition system as set forth in claim 1 wherein the engine operates on a two cycle crankcase compression principle.

12. A spark ignition system as set forth in claim 11 wherein the charge forming means comprises fuel injection means for directly charging a fuel into the combustion chamber.

13. A spark ignition system as set forth in claim 12 wherein the means for firing the spark plug means fires it at a higher energy level when the fuel/air charge is stratified.

14. A spark ignition system as set forth in claim 13 wherein the higher energy level is achieved by providing a greater current flow across the spark plug when the charge is stratified.

15. A spark ignition system as set forth in claim 14 wherein the higher energy level is derived from a capacitor discharge ignition system by charging the capacitor at a higher voltage when the charge is stratified.

16. A spark ignition system as set forth in claim 12 wherein the means for firing the spark plug fires the spark plug for a longer duration when the fuel/air charge is stratified.

17. A spark ignition system as set forth in claim 16 wherein the longer duration is achieved by providing a longer length of time which the spark plug fires.

18. A spark ignition system as set forth in claim 17 wherein the spark plug is fired by a capacitor discharge circuit and the time is firing is extended by multiple capacitor discharges during the spark interval.

19. A spark ignition system as set forth in claim 16 wherein the spark plug duration of firing is increased by firing the spark plug at a multiple number of times.

20. A spark ignition system as set forth in claim 19 wherein the multiple firing of the spark plug is achieved by a capacitor discharge circuit having a plurality of capacitors and thyristers for selectively discharging the capacitors.

21. A spark ignition system as set forth in claim 20 wherein there are a lesser number of capacitors and thyristers than the number of times the spark plug is fired so that each capacitor is discharged a plurality of times during a single cycle of the engine.

22. A method of operating a spark ignition system for an internal combustion engine having a combustion chamber, charge forming means for charging a fuel/air mixture into the combustion chamber, the charge forming means selectively charging the combustion chamber with either a stratified or a homogenous fuel/air charge, spark plug means in the combustion chamber for firing the fuel/air charge therein, comprising the step of firing the spark plug means at a higher energy level or longer duration the said fuel/air charge is stratified then when the fuel/air charge is homogenous.

23. A method of operating a spark ignition system as set forth in claim 22 wherein the spark plug is fired at a higher energy level when the fuel/air charge is stratified.

24. A method of operating a spark ignition system as set forth in claim 23 wherein the higher energy level is achieved by providing a greater current flow across the spark plug when the charge is stratified.

25. A method of operating a spark ignition system as set forth in claim 24 wherein the higher energy level is derived from a capacitor discharge ignition system by charging the capacitor at a higher voltage when the charge is stratified.

26. A method of operating a spark ignition system as set forth in claim 22 wherein the spark plug is fired for a longer duration when the fuel/air charge is stratified.

27. A method of operating a spark ignition system as set forth in claim 26 wherein the longer duration is achieved by providing a longer length of time which the spark plug fires.

28. A method of operating a spark ignition system as set forth in claim 27 wherein the spark plug is fired by a capacitor discharge circuit and the time is firing is extended by multiple capacitor discharges during the spark interval.

29. A method of operating a spark ignition system as set forth in claim 26 wherein the spark plug duration of firing is increased by firing the spark plug at a multiple number of times.

30. A method of operating a spark ignition system as set forth in claim 29 wherein the multiple firing of the spark plug is achieved by a capacitor discharge circuit having a plurality of capacitors and thyristers for selectively discharging the capacitors.

31. A method of operating a spark ignition system as set forth in claim 30 wherein there are a lesser number of capacitors and thyristers than the number of times the spark plug is fired and each capacitor is discharged a plurality of times during a single cycle of the engine.

32. A method of operating a spark ignition system as set forth in claim 22 wherein the engine operates on a two cycle crankcase compression principle.

33. A method of operating a spark ignition system as set forth in claim 32 wherein the charge forming means comprises fuel injection means for directly charging a fuel into the combustion chamber.

34. A method of operating a spark ignition system as set forth in claim 33 wherein the spark plug is fired at a higher energy level when the fuel/air charge is stratified.

35. A method of operating a spark ignition system as set forth in claim 34 wherein the higher energy level is achieved by providing a greater current flow across the spark plug when the charge is stratified.

36. A method of operating a spark ignition system as set forth in claim 35 wherein the higher energy level is derived from a capacitor discharge ignition system by charging the capacitor at a higher voltage when the charge is stratified.

37. A method of operating a spark ignition system as set forth in claim 33 wherein the spark plug is fired for a longer duration when the fuel/air charge is stratified.

38. A method of operating a spark ignition system as set forth in claim 37 wherein the longer duration is achieved by providing a longer length of time which the spark plug fires.

39. A method of operating a spark ignition system as set forth in claim 38 wherein the spark plug is fired by a capacitor discharge circuit and the time is firing is extended by multiple capacitor discharges during the spark interval.

40. A method of operating a spark ignition system as set forth in claim 37 wherein the spark plug duration of firing is increased by firing the spark plug at a multiple number of times.

41. A method of operating a spark ignition system as set forth in claim 40 wherein the multiple firing of the spark plug is achieved by a capacitor discharge circuit having a plurality of capacitors and thyristers for selectively discharging the capacitors.

42. A method of operating a spark ignition system as set forth in claim 41 wherein there are a lesser number of capacitors and thyristers than the number of times the spark plug is fired and each capacitor is discharged a plurality of times during a single cycle of the engine.

* * * * *